US005362257A

United States Patent [19]

Neal et al.

[11] Patent Number: 5,362,257

[45] Date of Patent: Nov. 8, 1994

[54] COMMUNICATIONS CONNECTOR TERMINAL ARRAYS HAVING NOISE CANCELLING CAPABILITIES

[75] Inventors: Donald R. Neal, Jupiter, Fla.; Carl G. Reed, Clemmons, N.C.; Clifford F. Lincoln, Atlanta, Ga.; Julian J. Ferry, Kernersville, N.C.

[73] Assignee: The Whitaker Corporation, Wilmington, Del.

[21] Appl. No.: 88,934

[22] Filed: Jul. 8, 1993

[51] Int. Cl.[5] ..... H01R 23/02

[52] U.S. Cl. ..... 439/676

[58] Field of Search ..... 439/676, 108, 894.1; 174/32, 39

[56] References Cited

U.S. PATENT DOCUMENTS

| | | | |
|---|---|---|---|
| 5,094,631 | 3/1992 | Suzuki | 439/676 |
| 5,186,647 | 2/1993 | Denkmann et al. | 439/395 |
| 5,269,708 | 12/1993 | DeYoung et al. | 439/676 |
| 5,282,754 | 1/1994 | Kish et al. | 439/676 X |

OTHER PUBLICATIONS

TIA/EIA Telecommunications Systems Bulletin; *Additional Transmission Specifications for Unshielded Twisted-Pair Connecting Hardware;* TSB40; Aug. 1992.

Physical Design of Electronic Systems; *Design Technology;* vol. 1; 1970.

*Primary Examiner*—Eugene F. Desmond

*Attorney, Agent, or Firm*—William B. Noll

[57] ABSTRACT

This invention relates to electrical connector terminal arrays, having interference canceling characteristics that meet or exceed the performance requirements of Category 5 components. The arrays are suited for producing connectors of the type for mounting to a printed circuit board. The connectors comprise a dielectric housing into which are mounted four pairs of electrical conductors. The conductors are arranged essentially in parallel fashion where the respective one ends thereof are spaced apart a first uniform distance, and the other respective ends thereof are spaced apart a second uniform distance greater than the first uniform distance. The conductors are further characterized by being arranged in a non-contact overlapping arrangement with the respective conductors of each outer pair in a single overlap of each other. The respective conductors of the center pair cross each other and then each crosses the adjacent conductor twice. By this arrangement, for an 8-conductor connector of the plug and receptacle type, the inner pairs of conductors exhibit a NEXT Loss of at least 45.00 at 100 MHz.

9 Claims, 9 Drawing Sheets

10
20
18
12
12
14
16
10'
10
18
12
12
14
16
20
10'

COMMUNICATIONS CONNECTOR TERMINAL ARRAYS HAVING NOISE CANCELLING CAPABILITIES

The present invention is directed to electrical connector terminal arrays for electrical connectors, where such arrays offer interference canceling characteristics. The connectors utilizing same are particularly adapted for the telecommunication and electronic industry, where performance requirements have significantly increased to a level identified by industry standards as Category 5. This level of performance is due in large measure to the need for increased data transmission rates requiring improved connecting devices, or hardware.

The Telecommunications Industry Association (TIA) in cooperation with the Electronic Industries Association (EIA) has developed a proposed standard for Category 5 components, where the transmission requirements of such components are characterized up to 100 MHz and are typically intended for emerging applications with transmission rates up to 100 Mbps. The standard is preliminarily identified as TSB40, August 1992. The invention hereof relates to the hardware, but it is important to note that the hardware is only one major element of a communication system, while another major component is the transmission cable. Thus, it is important to ensure the use of the correct connecting component or hardware that is compatible with the transmission characteristics of the cable. Such cables are typically high performance unshielded twisted-pair (UTP) cables, the performance characteristics of which are covered by EIA/TIA bulletin TSB-36.

Two important test parameters for high performance hardware, i.e. Category 5, are Attenuation and Near-end Cross-Talk (NEXT) Loss where Attenuation may be defined as a measure of signal power loss due to the connecting hardware and is derived from swept frequency voltage measurements on short lengths of 100-ohm twisted pair test leads before and after splicing-in the connector under test. The worst case attenuation of any pair within a connector shall not exceed the values listed below in TABLE I, where for Category 5, the values correspond approximately with attenuation that is equivalent to a 2 meter cable,

TABLE I

| UTP Connecting Hardware Attenuation | |
|---|---|
| Frequency (MHz) | Category (dB) |
| 1.0 | 0.1 |
| 4.0 | 0.1 |
| 8.0 | 0.1 |
| 10.0 | 0.1 |
| 16.0 | 0.2 |
| 20.0 | 0.2 |
| 25 | 0.2 |
| 31.25 | 0.2 |
| 62.5 | 0.3 |
| 100 | 0.4 |

Near-end crosstalk loss, the more significant problem, may be defined as a measure of signal coupling from one circuit to another within a connector and is derived from swept frequency voltage measurements on short lengths of 100-ohm twisted-pair test leads terminated to the connector under test. A balanced input signal is applied to a disturbing pair of the connector while the induced signal on the disturbed pair is measured at the near-end of the test leads. In other words, NEXT loss is the way of describing the effects of signal coupling causing portions of the signal on one pair to appear on another pair as unwanted noise. This will become more clear in a description of the test data which appears in TABLE III. In any case, the worst case NEXT loss, see values below in TABLE II, for any combination of disturbing and disturbed pairs is determined by the formula:

$$\text{NEXT}(F) \geqq \text{NEXT}(16) - 20 \log (F/16)$$

where NEXT (16) is the minimum NEXT loss at 16 MHz, F is frequency (in MHz) in the range from 1 MHz to the highest referenced frequency, and NEXT (F) is the performance at that frequency.

TABLE II

| UTP Connecting Hardware NEXT Loss Limits As Specified in EIA/TIA Document TSB-40 | |
|---|---|
| Frequency (MHz) | Category 5 (dB) |
| 1.0 | >65 |
| 4.0 | >65 |
| 8.0 | 62 |
| 10.0 | 60 |
| 16.0 | 56 |
| 20.0 | 54 |
| 25 | 52 |
| 31.25 | 50 |
| 62.5 | 44 |
| 100 | 40 |

U.S. Pat. No. 5,186,647 to Denkmann et al., represents a recent development in the disclosure of an electrical connector for conducting high frequency signals, where a major objective thereof is to reduce crosstalk between specific conductors in the connector. A preferred embodiment thereof is a panel mount modular jack which includes a pair of lead frames, each comprising four, flat elongated conductors. The lead frames are mounted on top of each other and their conductors are all generally parallel and close to each other. Only three of the conductors of each lead frame are arranged to overlap each other; and this occurs in a designated crossover region without electrical contact being made because of a reentrant bend in the conductors in the crossover region. As viewed in the assembled condition, the respective conductors within pairs 1-2, 4-5, and 7-8 overlap, while conductors 3 and 6 are free of any conductor overlap.

With the present invention, it was discovered that a more complex arrangement, involving all conductors, was needed to achieve consistently high performance. It was further discovered that the terminal arrays hereof exhibited reduced noise caused by inductive and capacitive coupling between adjacent signal paths in electrical conductors. Additionally, the arrays according to this invention, with their unique manner of crossing conductors, also reduce the electrical interference coupled to and from nearby circuits caused by electrical signals passing through conductors and terminals. These features will become apparent in the description and data which follow, particularly when read in conjunction with the accompanying drawings.

SUMMARY OF THE INVENTION

This invention is directed to electrical connector terminal arrays, particularly suited for producing jack receptacle type connectors for mounting to a printed circuit board. The connector comprises a dielectric housing into which are mounted, after encapsulation within a molded insert, two terminal arrays that provide four pairs of electrical conductors, where the conductors are arranged essentially in parallel fashion. The respective one ends of the conductors, such as the signal entry ends, are spaced apart a first uniform distance, while the other respective ends thereof are spaced apart a second uniform distance greater than said first uniform distance. The conductors are further characterized by being arranged in a non-contact overlapping arrangement with the respective conductors of each outer pair in a single overlap of each other, and the respective conductors of the center pair crossing each other and then each crossing the adjacent conductor twice. By this arrangement of conductors, the inner pairs of the conductors exhibit a NEXT Loss of at least 45.00 dB at 100 MHz, a value well above that which is necessary to satisfy Category 5 performance requirements.

BRIEF DESCRIPTION OF DRAWINGS

FIG. 3 is a perspective view of the carrier strips with conductors of FIG. 1.

DETAILED DESCRIPTION OF PREFERRED EMBODIMENT

The present invention is directed to electrical conductor terminal arrays which, by their unique conductor configuration, offer reduced electrical noise caused by inductive and capacitive coupling and voltage imbalance between adjacent signal paths in electrical connectors intended for the telecommunication industry. Connectors, typically of the plug and jack receptacle type, are controlled by FCC regulations to ensure compatibility between equipment from various manufacturers. Unfortunately, however, the conductor pair assignments specified in EIA/TIA 56B standard are not optimum for meeting the Category 5 requirement of low Near End Crosstalk which is the description used to describe the effects of unwanted signal coupling causing portions of the signal on one pair to appear on another pair as unwanted noise. Typical standard RJ45 connectors have approximately 100 MHz crosstalk loss of 28 dB on the 4-5→3-6 pairs, the critical internal pairs of an eight conductor assembly. By way of further reference and understanding, as viewed from the top of a planar arrangement of conductors, such conductors are numbered consecutively from 1 to 8, left to right. Additionally, such conductors exhibit alternating polarity from "1 positive" to "8 negative".

Figure 1:
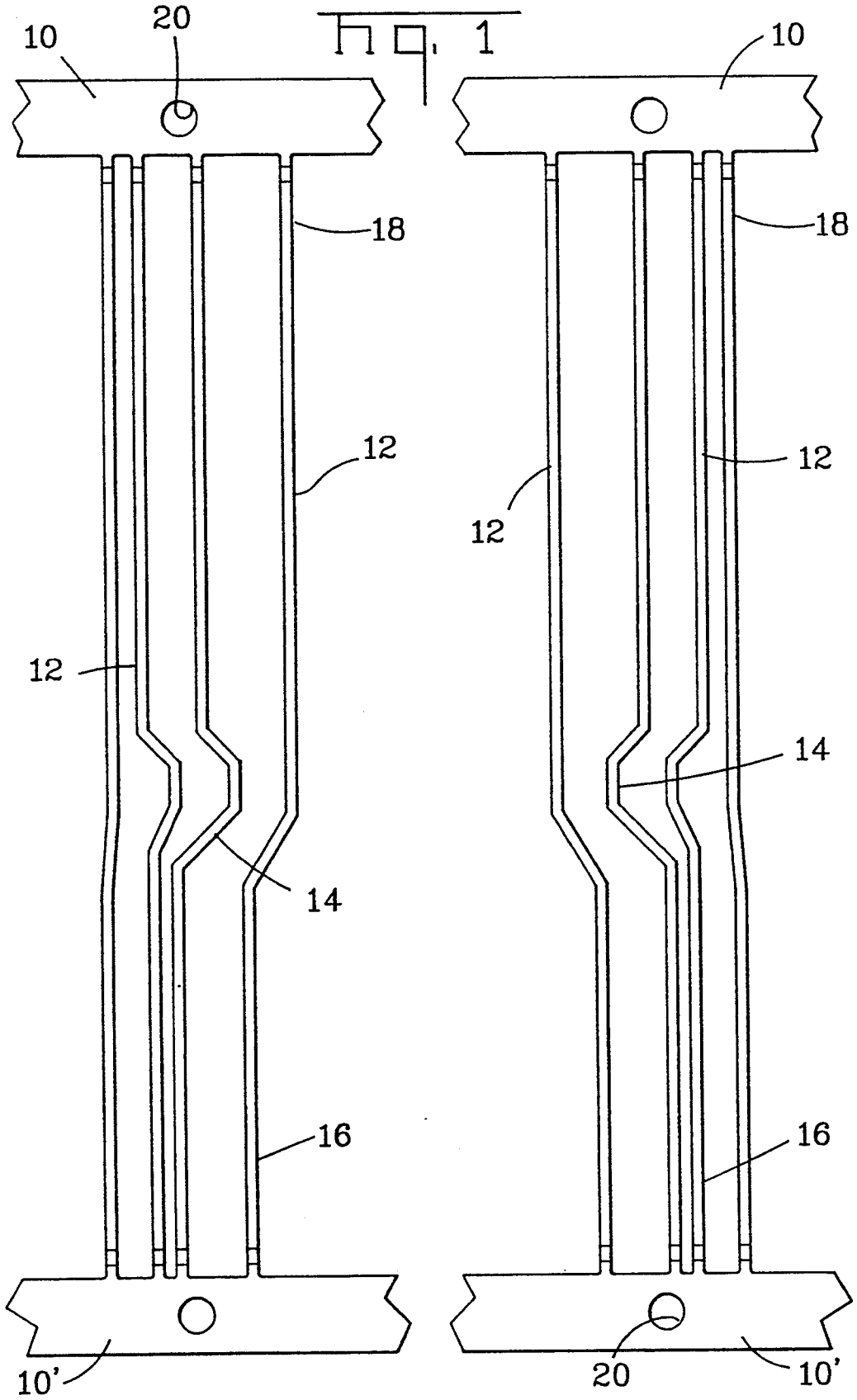
FIG. 1 illustrates a top and bottom view of a pair of carrier strips including plural conductors therebetween, which when arranged in back-to-back fashion form the initial preferred conductor array crossover configuration according to this invention.

With this understanding, reference may now be made to the several figures, where FIGS. 1–4 represent the preferred embodiment of developing the unique arrangement or crossover pattern of conductors. FIG. 1 illustrates at the left a pair of carrier strips 10, 10' with four individual conductors 12 extending therebetween, where the assembly is typically stamped from a sheet metal strip, such as phosphor bronze. Though only one combination has been shown, it will be understood that the carrier strips 10, 10', are continuous or endless with an identical repeat of like conductor arrays or groups arranged therebetween. To the right in FIG. 1, the array is shown as viewed from the bottom. In the two views, the various conductors 12 are each provided with a crossover section 14, where the otherwise parallel ends 16 are shifted to different but parallel paths at the opposite end 18. Finally, the carrier strips 10, 10' are provided with registration holes 20. With the respective arrays of FIG. 1 arranged to lie contiguous in a back-to-back relationship, and the respective registration holes 20 aligned, the new eight conductor combination array of FIG. 2 results.

Figure 4:
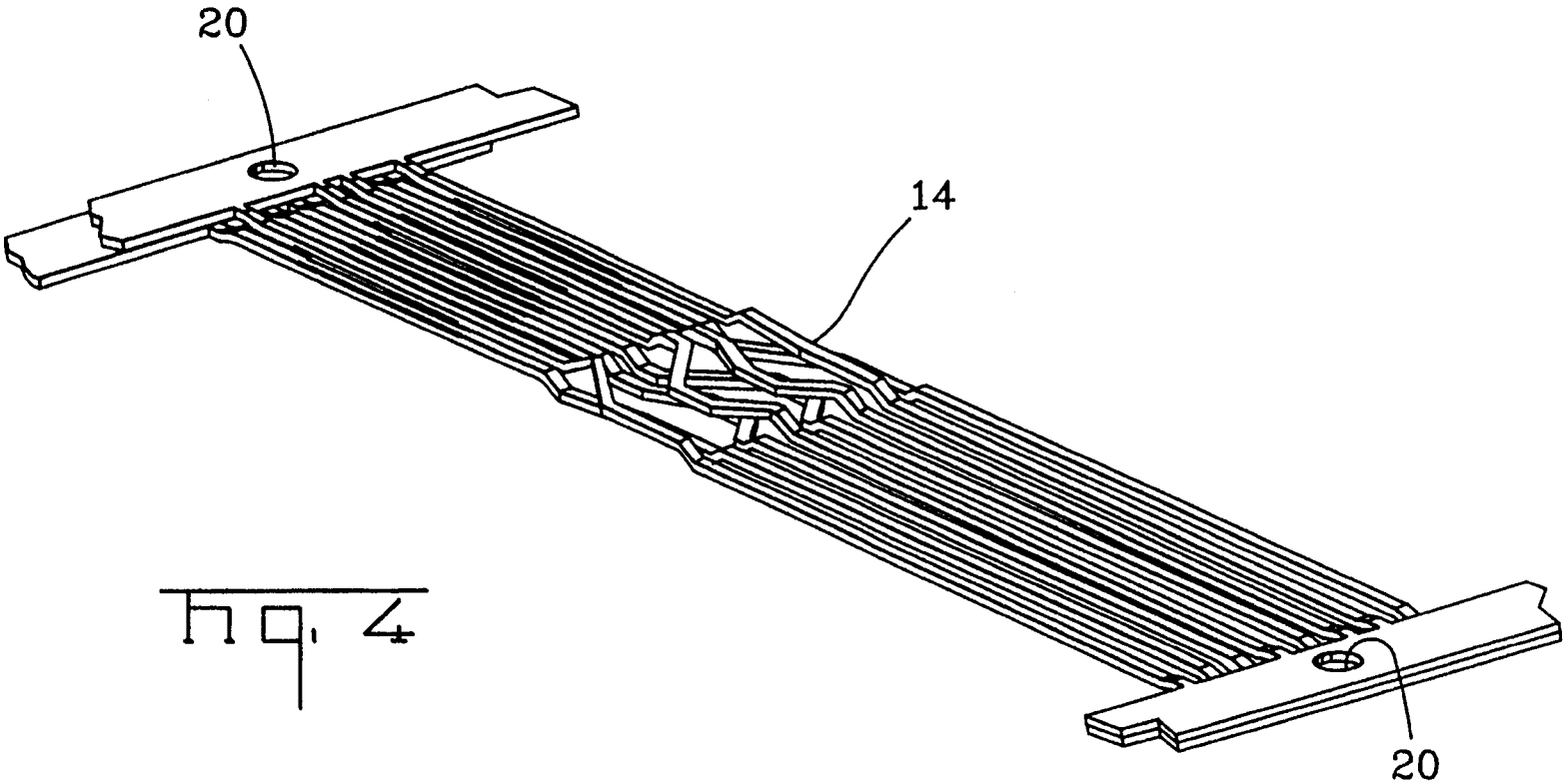
FIG. 4 is a perspective view of the carrier strips with the 4 pair crossover configuration of FIG. 2.

In order to avoid conductor contact in the crossover section 14, the path of the conductor is changed, see FIGS. 3 and 4. In a right-handed coordinate system, where the plane of the carrier strips 10 and array of conductors 12 of FIG. 1 define the X-Y plane, and the Z direction is orthonormal thereto, the conductors are shifted not only in the X-Y plane, but in the Z direction. By suitably bending the conductors, in the manner illustrated, contact during crossover is avoided and the cancellation characteristics are enhanced. A preferred, uniform crossover spacing is 0.018 inches.

Figure 2:
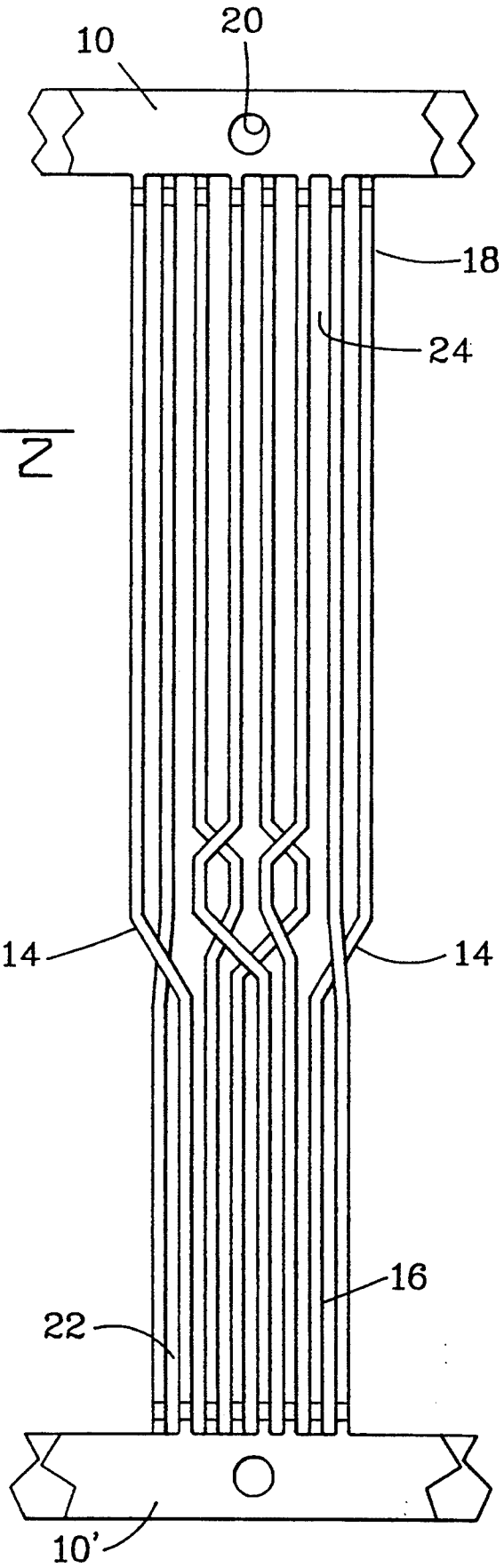
FIG. 2 is a top view showing the two carrier strips with conductors of FIG. 1 in the initial back-to-back relationship forming the unique 4 pair configuration.

As best seen by the illustration of FIG. 2, the new eight conductor array shows the parallel ends 16, signal entry end, as having a uniform predetermined spacing 22, while the opposite parallel ends 18, the signal exit end, shows a wider or broader, uniform spacing 24. In a preferred embodiment the spacings 22 may be 0.040 inches, with spacings 24 at 0.050 inches. With the wider spacings of the exit or outcoming conductors, it was discovered that there is less susceptibility to noise retention at the conductor ends 18.

Returning to the cross-over pattern in the array of conductors of FIG. 2, it will be seen that conductors are subjected to a crossover from at least one other conductor. In the respective outer pairs, namely pairs 1-2 and 7-8, there is just a single angled crossover within the section 14. However, the crossover patterns of the inner conductors 3-4-5-6 are significantly different. Conductors 4 and 5 cross each other and then each crosses the adjacent 3 or 6 conductor twice. As will be demonstrated in the data and description which follows, the inner conductors 3-4-5-6, specifically the pairs 4-5 and 3-6, are the critical areas for the worst cross talk problems.

In preparing the conductor array for inclusion in a suitable connector housing, the array of FIGS. 2 and 4 is subjected to an insert molding operation, as known in the art. The exit ends 18 of the conductors 12 are arranged by separating the conductor ends 18 of four conductors from the carrier strip 10, bending them out of the plane of the remaining conductors, then realigning the free conductor ends 18' in a second plane, parallel to the plane of the remaining conductors, see FIG. 5.

Figure 5:
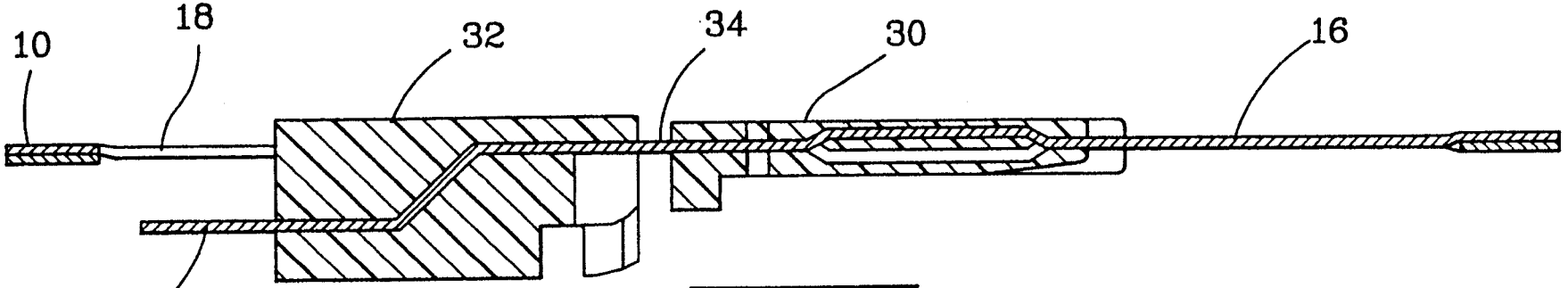
FIG. 5 is a sectional view of the pair of carrier strips with conductors of FIG. 4 that have been insert molded prior to forming and inserting into a dielectric housing assembly.
Figure 6:
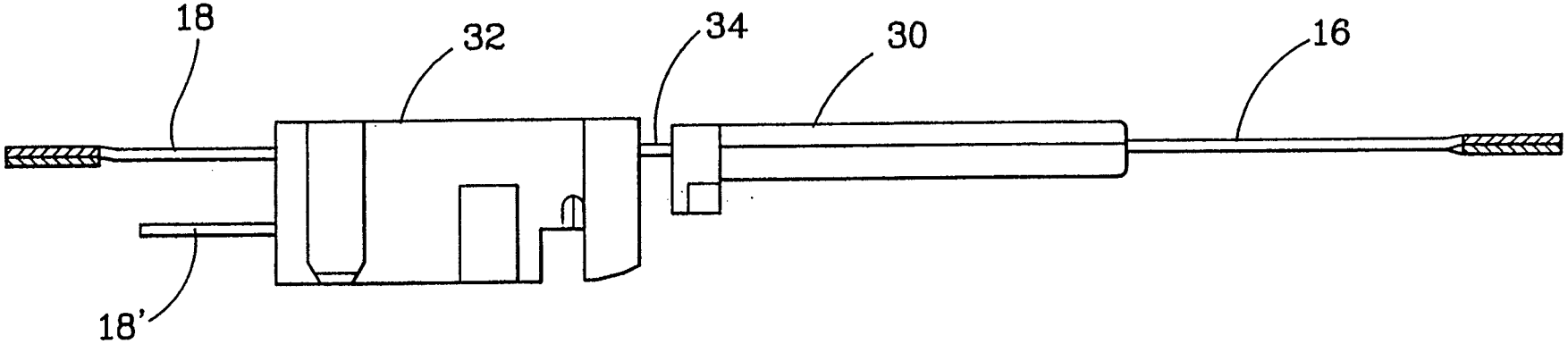
FIG. 6 is a side view of the insert molded assembly of FIG. 5.
Figure 7:
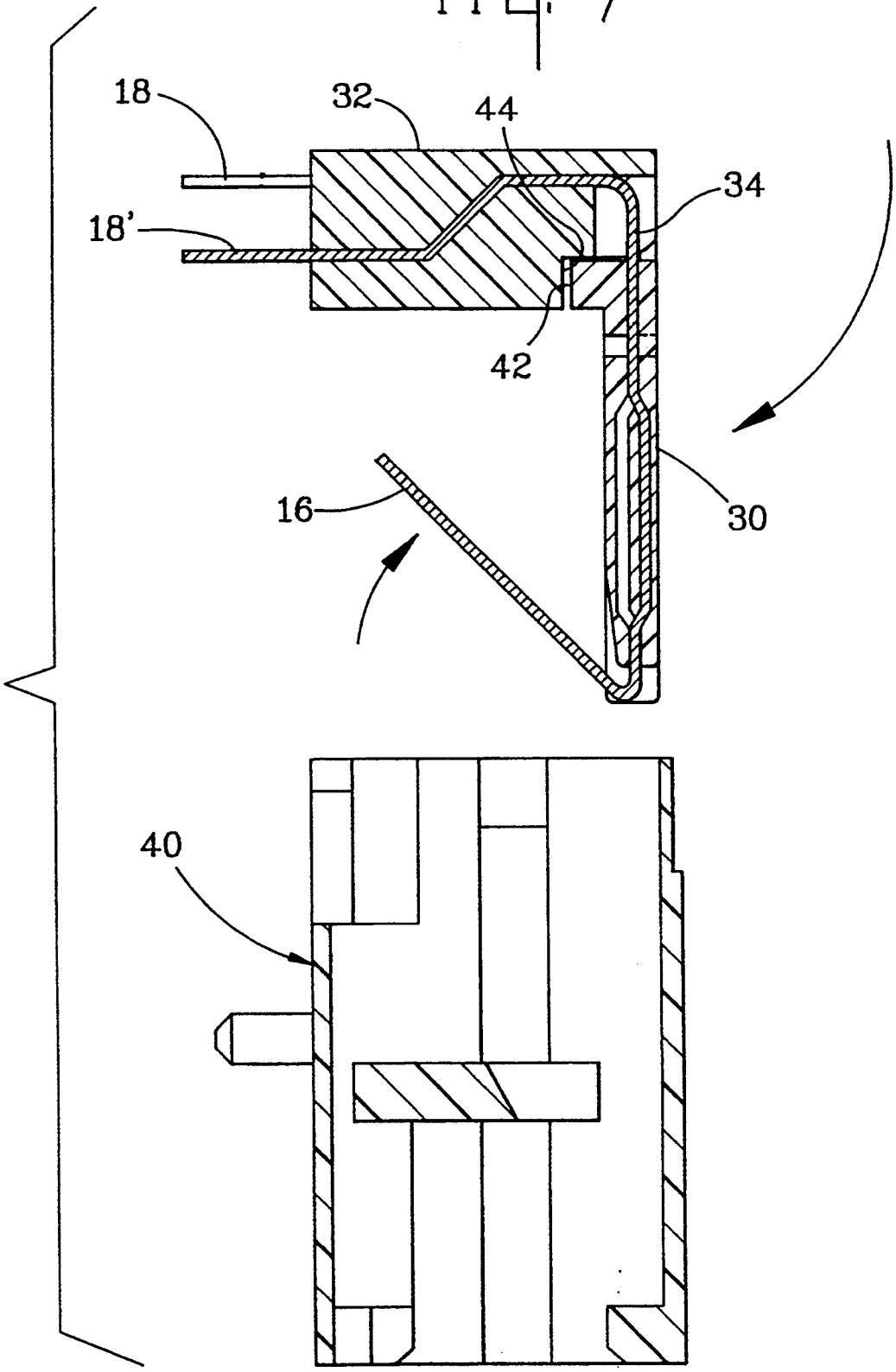

In this arrangement, with the use of spacers, as known in the molding art, to ensure precise spacing, preferably 0.018 inches, in the cross over portion 14, the eight conductor array is subjected to an insert molding operation. Specifically, the respective cross over portion 14 of conductors is fully encapsulated within a plastic insert material 30, having a specified dielectric constant. Concurrently, the conductor ends 18, 18' are encapsulated by a second, spaced-apart insert 32. As seen in FIGS. 5 and 6, the two molded inserts 30, 32 are joined only by the conductor sections 34.

Figure 7:
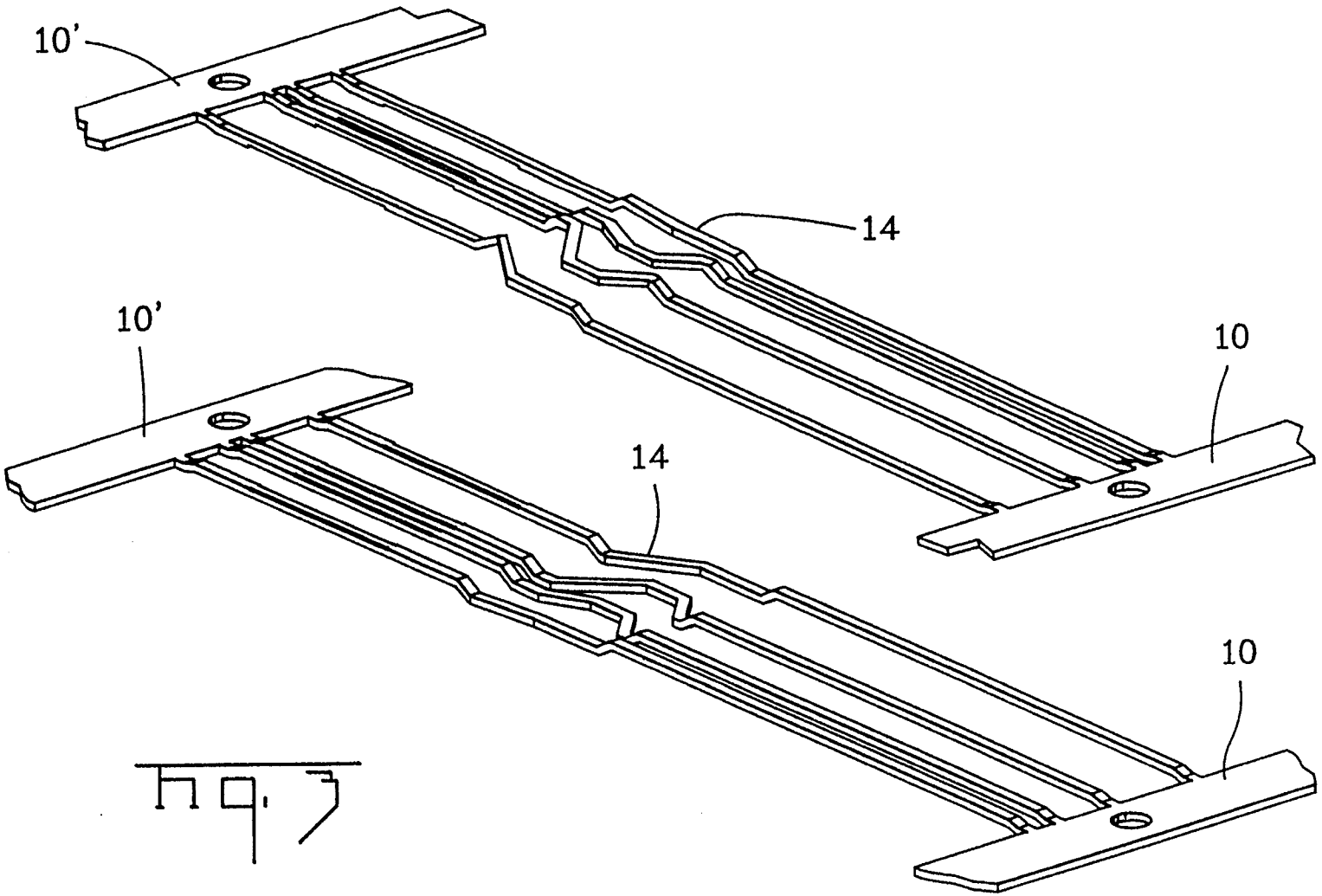
FIG. 7 is a sectional view of the formed insert molded assembly just prior to its insertion into a dielectric plug receiving housing assembly.

FIG. 7 illustrates, with the aid of the direction arrows, a preferred manner by which the inserts 30, 32 may be arranged to form a unitary insert assembly for housing 40. That is, insert 30 is pivoted 90° about the conductor sections 34, where the projection 42 seats on shoulder 44. Note that the carrier strips 10, 10' have been removed to reveal eight free conductor ends at each end of the assembly. Additionally, the conductor ends 16, or the signal entry ends thereof, are uniformly bent to form plural cantilevered arms, a configuration as known in the art.

Figure 8:
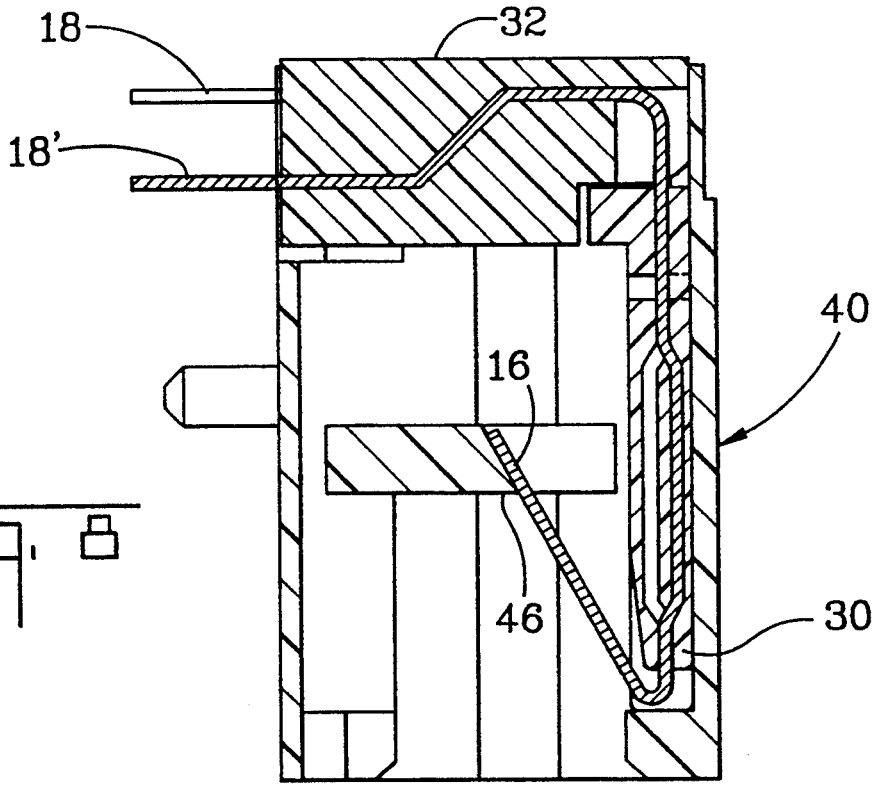
FIG. 8 is a sectional view of the dielectric plug receiving housing with insert mounted therein.
Figure 9:
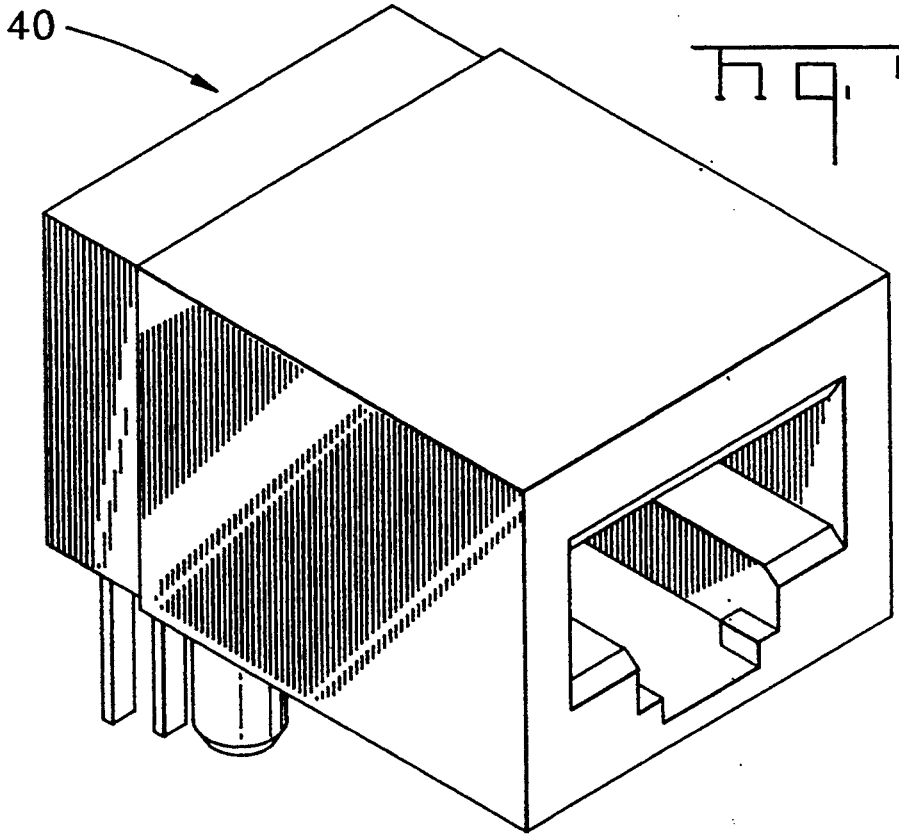
FIG. 9 is a perspective view of the assembly of FIG. 8, as may be constructed in accordance with this invention.

With the insert assembly 30, 32 suitably positioned, the assembly may be pushed into housing 40 and seated therein as illustrated in FIG. 8. The resulting connector, an external view illustrated in FIG. 9, shows the free cantilevered conductor ends 16 resting on a plastic comb 46, as known in the art, while the conductor exit ends 18, 18' extend below the housing 40, to be electrically interconnected to a printed circuit board, not shown, by soldering as practiced in the electronic equipment art, particularly in mounting of electrical connectors to a printed circuit board, where the connectors are preferably top entry or right angle connectors, as known in the art.

Figure 10:
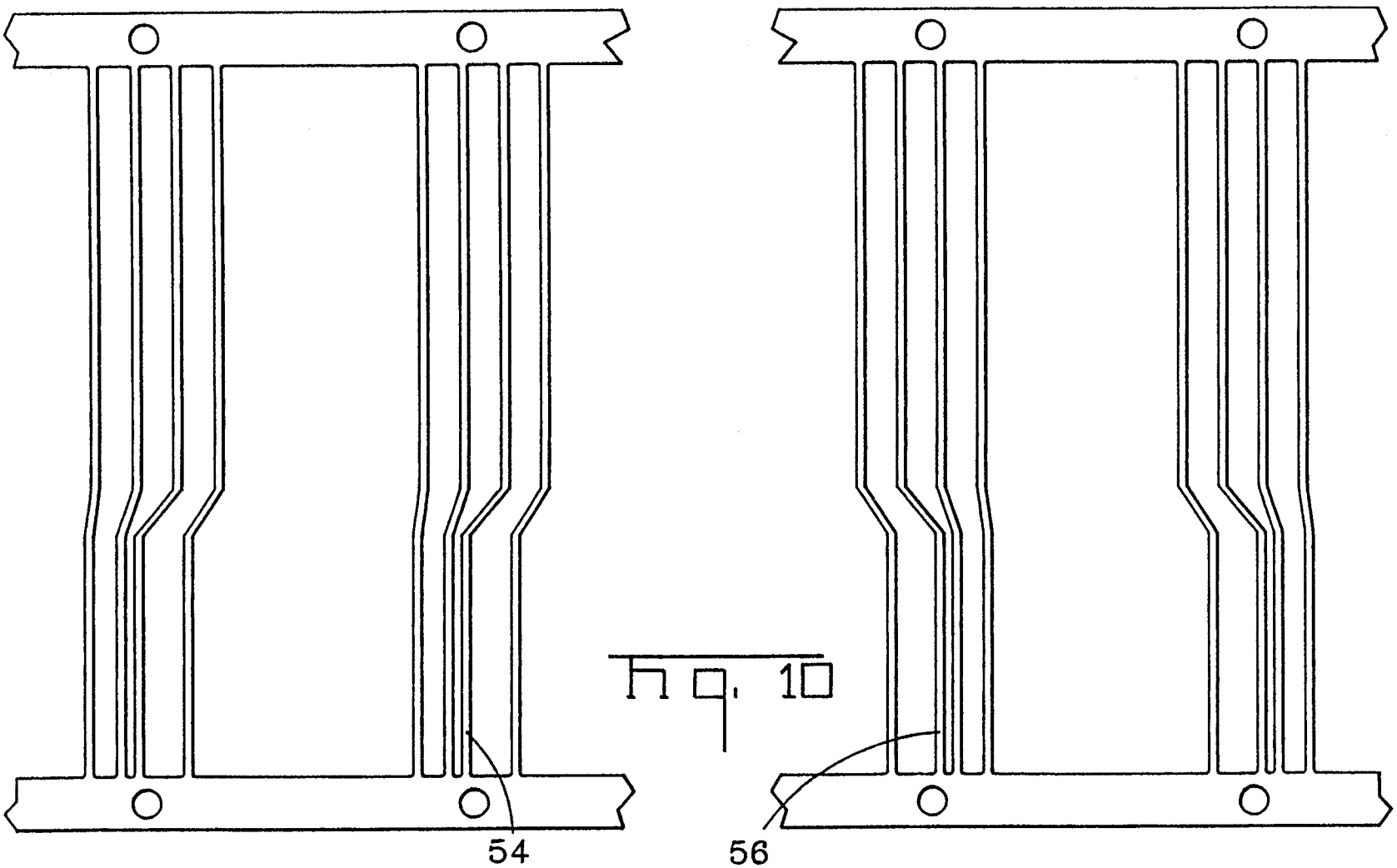
FIG. 10 illustrates a top and bottom view of an alternate embodiment to the array configuration of FIG. 1.

Having described the assembly and conductor configuration of this invention, a series of comparative tests were conducted using the conductor array configuration of present FIG. 2, and a conductor configuration according to the prior art, as exemplified by FIG. 10 of U.S. Pat. No. 5,186,647. The series of tests included monitoring the induced signal of each designated pair of conductors from another pair. The results thereof are presented below in TABLE III.

TABLE III

| NEXT LOSS PERFORMANCE | | |
|---|---|---|
| Frequency MHz | Patent No. 5,186,647 (FIG. 10) dB | Invention (FIG. 2) dB |
| Pair 4–5(excited)/Pair 3–6 (monitored) | | |
| 1.00 | 93.3314 | 97.3065 |
| 4.00 | 88.7672 | 81.9149 |
| 8.00 | 80.4310 | 75.3686 |
| 10.00 | 77.2740 | 73.1538 |
| 16.00 | 70.9399 | 69.2165 |
| 20.00 | 67.5173 | 67.0602 |
| 25.00 | 63.5836 | 64.5806 |
| 31.25 | 60.3561 | 62.3623 |
| 62.50 | 48.6911 | 53.8529 |
| 100.00 | 40.7497 | 47.1532 |
| Pair 4–5 (excited)/Pair 1–2 (monitored) | | |

TABLE III-continued

| NEXT LOSS PERFORMANCE | | |
|---|---|---|
| Frequency MHz | Patent No. 5,186,647 (FIG. 10) dB | Invention (FIG. 2) dB |
| 1.00 | 92.5334 | 85.7093 |
| 4.00 | 76.6522 | 74.9716 |
| 8.00 | 70.6734 | 68.9445 |
| 10.00 | 68.7324 | 66.9674 |
| 16.00 | 64.6435 | 62.8523 |
| 20.00 | 62.8112 | 60.8393 |
| 25.00 | 60.9890 | 59.0475 |
| 31.25 | 58.9276 | 57.1324 |
| 62.50 | 53.1518 | 51.0579 |
| 100.00 | 49.3147 | 47.1061 |
| Pair 4–5 (excited)/Pair 7–8 (monitored) | | |
| 1.00 | 83.2705 | 97.9650 |
| 4.00 | 77.0405 | 86.4777 |
| 8.00 | 70.7822 | 79.3665 |
| 10.00 | 68.9286 | 78.0388 |
| 16.00 | 64.9881 | 74.6697 |
| 20.00 | 62.9083 | 72.5942 |
| 25.00 | 60.9954 | 70.0994 |
| 31.25 | 59.1458 | 67.7972 |
| 62.50 | 53.3385 | 60.7337 |
| 100.00 | 49.5746 | 55.2020 |
| Pair 3–6 (excited)/Pair 1–2 (monitored) | | |
| 1.00 | 92.5377 | 83.7281 |
| 4.00 | 83.2459 | 72.1978 |
| 8.00 | 76.4361 | 66.6110 |
| 10.00 | 75.1494 | 64.6226 |
| 16.00 | 70.4325 | 60.8918 |
| 20.00 | 68.2740 | 58.7496 |
| 25.00 | 66.3846 | 56.8689 |
| 31.25 | 64.1155 | 54.8807 |
| 62.50 | 56.1150 | 49.1693 |
| 100.00 | 49.9030 | 45.1703 |
| Pair 3–6 (excited)/Pair 7–8 (monitored) | | |
| 1.00 | 92.5310 | 81.6298 |
| 4.00 | 81.6436 | 75.2836 |
| 8.00 | 75.7535 | 69.4032 |
| 10.00 | 74.3237 | 67.6514 |
| 16.00 | 69.8561 | 63.5985 |
| 20.00 | 67.9682 | 61.6780 |
| 25.00 | 65.8369 | 59.8341 |
| 31.25 | 63.5317 | 57.8692 |
| 62.50 | 55.6964 | 51.9807 |
| 100.00 | 49.5146 | 47.8650 |
| Pair 1–2 (excited)/Pair 7–8 (monitored) | | |
| 1.00 | 96.8048 | 93.6805 |
| 4.00 | 89.1507 | 97.9109 |
| 8.00 | 85.2356 | 92.1488 |
| 10.00 | 83.7602 | 94.9492 |
| 16.00 | 78.7884 | 101.859 |
| 20.00 | 76.2289 | 103.382 |
| 25.00 | 75.5069 | 89.4310 |
| 31.25 | 72.2444 | 93.8751 |
| 62.50 | 66.8171 | 87.5811 |
| 100.00 | 62.4969 | 88.8738 |

The critical area of crosstalk problem lies with the internal conductor pairs, namely, pairs 4-5 and 3-6. The initial data of TABLE III directly compares the NEXT Loss performance of such pairs according to the crossover configuration of U.S. Pat. No. 5,186,647 and the present invention. In each case, as the frequency increases, the NEXT Loss in dB drops significantly toward the EIA/TIA minimum standard, of 40.00, at 100 MHz. The prior art connector tested just barely meets the minimum, wherein by the use of the unique crossover pattern of the present invention, a nearly 7.00 dB performance improvement is found at a comparable frequency.

Outside the area of such critical pairs, the NEXT Loss performance is generally good for each of the illustrated conductor crossover patterns. However, it is significant to note that for all combinations of pairs, the present invention consistently produced NEXT Loss performance in excess of 45.00, more than 5.00 dB above the minimum requirements for Category 5 produces.

Figure 11:
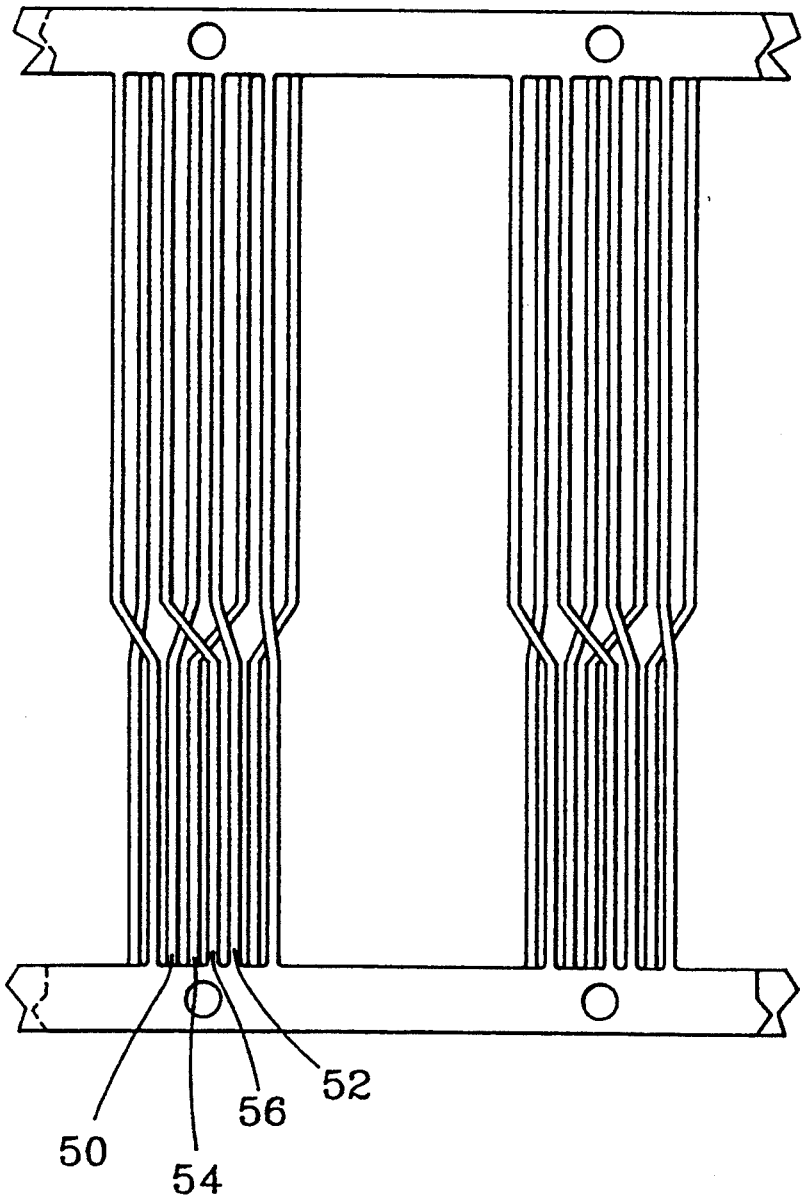
FIG. 11 is a top view, similar to FIG. 2, showing the alternate 4 pair configuration of the conductors of FIG. 10 in the initial back-to-back relationship.

FIGS. 10 and 11 represent an alternate embodiment to a unique 4 pair conductor cross over configuration according to this invention. In this configuration, the conductors 4 and 5, identified as conductors 54 and 56 respectively, initially cross each other and then each crosses the adjacent 3 or 6 conductor before returning to a parallel and uniformly spaced position. To summarize, the unique conductor cross over configuration of this invention reveals a single cross over of the respective outer pairs, traditionally numbered and identified as pairs 1-2 and 7-8, whereas the inner pairs 3-6 and 4-5, exhibit a situation of at least a double cross over by two of the conductors forming the said inner pairs.

We claim:

1. Electrical connector terminal arrays consisting of a plurality of metal conductors specifically configured to enhance high frequency transmission performance through reduction of inductive and capacitive coupling and voltage imbalance between selected conductor pairs, said conductors arranged essentially in a parallel fashion where the respective one ends thereof are spaced apart a first uniform distance, and the other respective ends thereof are spaced apart a second uniform distance greater than said first distance, characterized by a central portion for said metal conductors, where said central portion is encapsulated in a plastic material, having a specified dielectric constant, to maintain the relative position of said metal conductors, said relative position being a non-contact overlapping relationship with the respective conductors of each outer pair in single crossover of each other, and the respective conductors of the center pair initially crossing and then continuing outward to cross the adjacent conductors twice, whereby said terminal arrays offer reduced crosstalk loss between adjacent signal paths when used in electrical connectors.

2. The electrical connector terminal arrays of claim 1, wherein said first uniform distance is about 0.040 inches, and said second uniform distance is about 0.050 inches.

3. The electrical connector terminal arrays of claim 1, wherein the conductor overlap spacing is a uniform distance of about 0.018 inches.

4. The electrical connector terminal arrays of claim 1, wherein said plastic encapsulation extends throughout the conductor overlapping arrangement from a location where the conductors are parallel along said first uniform distance to a location where said conductors are parallel along said second uniform distance.

5. The electrical connector terminal array of claim 4 arranged within a connector housing to produce printed circuit board mounted right angle connectors having a NEXT Loss performance in excess of 45.00 dB at a frequency of 100 MHz.

6. Electrical connector terminal arrays consisting of four pairs of metal conductors specifically configured to enhance high frequency transmission performance through reduction of voltage imbalance and of inductive and capacitive coupling between selected conductor pairs, said conductors arranged essentially in parallel fashion where the respective one ends thereof are spaced apart a first uniform distance, and the other respective ends thereof are spaced apart a second uniform distance greater than said first distance, characterized by a central portion within which said conductors are encapsulated in a plastic material having a specified dielectric constant, said conductors arranged in a non-contact overlapping relationship with the respective conductors of each outer pair in a single crossover of each other, and the inner two pairs arranged such that at least two conductors thereof crossover two other of said inner conductors, whereby said terminal arrays offer a NEXT Loss performance in excess of 45.00 dB at a frequency of 100 MHz between adjacent signal paths when used in electrical connectors.

7. The electrical connector terminal arrays of claim 6, wherein said first uniform distance is about 0.040 inches, and said second uniform distance is about 0.050 inches.

8. The electrical connector terminal arrays of claim 6, wherein the conductor overlap spacing is a uniform distance of about 0.018 inches.

9. The electrical connector terminal arrays of claim 6, wherein said plastic encapsulation extends throughout the conductor overlapping arrangement from a location where the conductors are parallel along said first uniform distance to a location where said conductors are parallel along said second uniform distance.

* * * * *